US010731844B2

(12) United States Patent
Zhang et al.

(10) Patent No.: US 10,731,844 B2
(45) Date of Patent: Aug. 4, 2020

(54) LIGHTING APPARATUS

(71) Applicant: XIAMEN ECO LIGHTING CO. LTD., Xiamen (CN)

(72) Inventors: Runfu Zhang, Xiamen (CN); Jiaqing Zhuang, Xiamen (CN); Zhenqi Yan, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 16/381,400

(22) Filed: Apr. 11, 2019

(65) Prior Publication Data

US 2019/0234608 A1 Aug. 1, 2019

Related U.S. Application Data

(63) Continuation of application No. 15/486,271, filed on Apr. 12, 2017, now Pat. No. 10,295,171.

(30) Foreign Application Priority Data

Sep. 23, 2016 (CN) ..... 2016 1 0843669
Feb. 27, 2017 (CN) ..... 2017 1 0107480

(51) Int. Cl.
*F21V 33/00* (2006.01)
*F21V 23/00* (2015.01)
(Continued)

(52) U.S. Cl.
CPC ..... *F21V 33/0056* (2013.01); *F21K 9/232* (2016.08); *F21K 9/237* (2016.08); *F21K 9/238* (2016.08); *F21V 17/12* (2013.01); *F21V 19/0015* (2013.01); *F21V 23/003* (2013.01); *F21V 29/70* (2015.01); *H04R 1/028* (2013.01);
(Continued)

(58) Field of Classification Search
CPC ..... F21K 9/232; F21K 9/237; F21K 9/238; F21V 17/12; F21V 19/0015; F21V 23/003; F21V 29/70; F21V 33/0056; F21Y 2115/10; H04R 1/028; H04R 2400/00; H04R 2420/07; H04R 3/00; H05B 33/0809; H05B 37/0272
See application file for complete search history.

(56) References Cited

U.S. PATENT DOCUMENTS 5,295,194 A * 3/1994 Christensen ..... H04R 1/24 381/182
6,345,685 B1 * 2/2002 Wells ..... H04R 1/028 181/153

(Continued)

*Primary Examiner* — Tsion Tumebo
(74) *Attorney, Agent, or Firm* — Chun-Ming Shih; Lanway IPR Services

(57) ABSTRACT

The instant disclosure provides an LED light, including: a light cap, a hollow heat sink, a drive assembly, a speaker assembly, a light source assembly and a lampshade, wherein the light cap, the hollow heat sink and the lampshade are sequentially connected and form a receiving space, the drive assembly, the speaker assembly and the light source assembly sequentially arranged in the receiving space in the direction of the light cap to the lampshade, and the speaker assembly and the light source assembly are respectively electrically connected with the driving assembly, and the surface of the hollow heat sink provided with multiple holes, and the speaker assembly arranged facing the hole.

10 Claims, 9 Drawing Sheets

(51) Int. Cl.

| | |
|---|---|
| ***F21K 9/237*** | (2016.01) |
| ***F21K 9/238*** | (2016.01) |
| ***F21V 29/70*** | (2015.01) |
| ***F21V 19/00*** | (2006.01) |
| ***F21V 17/12*** | (2006.01) |
| ***H04R 1/02*** | (2006.01) |
| ***F21K 9/232*** | (2016.01) |
| ***H05B 45/37*** | (2020.01) |
| ***H05B 47/19*** | (2020.01) |
| ***H04R 3/00*** | (2006.01) |
| ***F21Y 115/10*** | (2016.01) |

(52) U.S. Cl.
CPC ..... *H05B 45/37* (2020.01); *H05B 47/19* (2020.01); *F21Y 2115/10* (2016.08); *H04R 3/00* (2013.01); *H04R 2400/00* (2013.01); *H04R 2420/07* (2013.01)

(56) References Cited

U.S. PATENT DOCUMENTS

| | | | | |
|---|---|---|---|---|
| 6,574,346 | B1 * | 6/2003 | Tanaka | H04R 3/002 381/413 |
| 9,668,053 | B1 * | 5/2017 | Rivera | H04R 3/12 |
| 2005/0024857 | A1 * | 2/2005 | Vishwamitra | A63J 17/00 362/152 |
| 2009/0196016 | A1 * | 8/2009 | Massara | F21V 23/0471 362/86 |
| 2013/0092362 | A1 * | 4/2013 | Chen | F21V 29/83 165/185 |
| 2013/0308315 | A1 * | 11/2013 | Capitani | H04R 1/028 362/253 |
| 2014/0029782 | A1 * | 1/2014 | Rayner | H04R 1/2834 381/386 |
| 2016/0057521 | A1 * | 2/2016 | Sun | H04R 1/028 381/334 |
| 2017/0195762 | A1 * | 7/2017 | Lin | H04R 1/026 |

* cited by examiner

LIGHTING APPARATUS

RELATED APPLICATION

The present application is a continued application of U.S. patent application Ser. No. 15/486,271 filed on Apr. 12, 2017.

TECHNICAL FIELD

The present disclosure relates to a lighting apparatus, and more particularly to a smart lighting apparatus.

BACKGROUND OF INVENTION

We rely on a variety of lighting apparatus, and life is also filled with multiple different lighting apparatuses. Some lighting apparatuses are fixed on the wall or ceiling, some are connected to the indoor power through the wire, and some are configured with a battery or other power supply. Although all of these examples belong to the lighting apparatuses, according to different using characteristics, there are some differences in these lighting apparatuses.

With the popularization of the light emitting diode technology, more and more lighting apparatuses adopt light emitting diode light source, and the apparatus for lighting apparatus also becomes more and more diverse.

Therefore, if we may design a product to meet the need of the human life and increase the life experience, the product may be able to bring considerable value and contribution to the society.

SUMMARY OF THE INVENTION

One of the technical problems of the present invention may be solved is to overcome the shortcomings of the prior arts described above and to provide a light emitting diode light with a speaker.

The embodiment of the instant disclosure that provides a LED light, including: a lamp cap, a hollow heat sink, a drive assembly, a speaker assembly, a light source assembly and a lampshade, one end of the hollow heat sink connected to the light cap, and the other end of the hollow heat sink connected to the lampshade. The driver assembly, the speaker assembly and the light source assembly provided in sequence from bottom to top in the hollow heat sink, and the speaker assembly and the light source assembly electrically connected to the drive assembly, respectively. Multiple holes are provided on the side wall of the hollow heat sink near the speaker assembly; the light source assembly emitted light toward the lampshade, the drive assembly being used for wireless communication with an electronic terminal apparatus and controlling the drive assembly to output a signal to the light source assembly and the speaker assembly.

As a further improvement, the hollow heat sink is a hollow cylindrical housing structure which is generally reduced in length from top to bottom, the hollow heat sink is set with an upper connecting portion at the top of the hollow heat sink, and the bottom of the hollow heat sink is set with a lower connecting portion.

As a further improvement, the lampshade is a hemispherical shell structure, and the opening shape of the lampshade is corresponded to the shape of the top of the hollow heat sink, the opening size of the lampshade is corresponded to the inner diameter on the top of the hollow heat sink, the lampshade is made of a transparent or translucent material integrally.

As a further improvement, the lampshade is fixed to the upper connecting portion of the hollow heat sink by means of glue or fastening.

As a further improvement, the light cap is sleeved and fixed to the lower connecting portion of the hollow heat sink and is electrically connected with the driving assembly.

As a further improvement, the LED light further includes multiple screws, the inner wall of the hollow heat sink is set with multiple support columns, two first mounting columns and three second mounting columns. The top end faces of multiple support columns are on the same horizontal plane as the top end faces of the first mounting columns; the top end faces of the second mounting columns are under the top end faces of the first mounting columns; the top end faces of the second mounting columns are on the same horizontal plane. When assembled, the speaker assembly is set on the top end faces of the second mounting column and fixed to the second mounting column by screw; the light source assembly is set on the top end face of the first mounting column and fixed to the first mounting column by the screw.

As a further improvement, the speaker assembly includes a substrate, a speaker, a shock absorbing washer, a sound guide channel and a sound outlet. The substrate includes a first surface and a second surface opposite to the first surface. The speaker, the shock absorbing washer, and the sound guide channel are set on the first surface; the sound outlet is set on the second surface and connected with the sound guide channel; and the lower end surface of the shock absorbing washer is abutted to the inner wall of the hollow heat sink.

As a further improvement, the sound guide channel is arc-shaped.

As a further improvement, multiple holes are elongated or rounded, and the holes are spaced set on the side wall around the upper portion of the hollow heat sink.

As a further improvement, the heat sink is made of a heat dissipating plastic material integrally.

Another embodiment of the instant disclosure provides a LED light, the LED light set with an Edison light cap, that is, a general standard light cap, may be shifted to a general ceiling light socket or a desk light socket. A general indoor power, such as 110V or 220V voltage may be leaded into the LED light through the light cap.

The LED light further includes a drive assembly, a light source assembly and a speaker assembly. The drive assembly includes a power conversion circuit for converting the indoor power supply into a low voltage drive current to drive the light source assembly and the speaker assembly. The drive assembly further includes a wireless communication circuit and a processing circuit. The wireless communication circuit receives the sound information from the external device. The processing circuit converts the received sound information into a driving signal corresponding to the speaker assembly and drives the speaker assembly to play the corresponding sound.

For example, this wireless communication circuit is a Bluetooth communication circuit, and the sound streaming may be obtained from the matched phone, TV, home server and may be played through the speaker assembly.

For example, the wireless communication circuit, in addition to the standard Bluetooth communication circuit, may include an additional communication circuit adopted a second wireless communication protocol, which is different from the first communication circuit protocol, such as the Bluetooth communication protocol. The second wireless protocol may interact with additional circuit, such as a wireless doorbell. When the wireless doorbell is pressed or the like, the additional communication circuit receives the touch information from the wireless doorbell, and the processing circuit plays the stored sound information to generate the sound of the doorbell. In addition, the processing circuit may further drive the light source assembly to remind using the light with the doorbell. This may provide a better experience for elderly people or someone who are injured in hearing.

Other examples about the second communication protocol further include mobile phone calls from mobile phones, or notification messages about the wearer from the wearable device, such as smart bracelet.

In addition, when the wireless communication circuit receives information from the first and the second communication protocol at the same time, and when the sound need to be played, the processing circuit would select one of the following setting to play the sound according to the preset rule.

The first setting is to pause the original playing sound, and play the sound effect corresponding to the new arrival information. For example, pause the playing music and play the doorbell. In order to avoid the doorbell being mistaken for a part of the music, pause the music first, matched with light effect of the light source assembly, and then play the doorbell notification The second setting is to hold the second message directly when one of the higher priority information is playing. For example, if a WeChat information is received when listening music, the WeChat information may not play directly but play at some other time, such as the music empty space or the time a song changed.

The third setting is to play the two sound messages simultaneously.

The user may preset the rule at the time leaving the factory, or communicate with the processing circuit through an external device, such as the mobile phone, or the wireless communication circuit, and make the relevant setting.

In addition, the LED light further provides a housing having a speaker effect. For example, the housing is an inverted tube speaker, and it may be designed to produce Mega bass by the structure design.

Another variant according to the above-described embodiment is that the housing in the design has no speaker. The outwardly facing portion of the housing includes a vibration diaphragm corresponding to the speaker assembly. The light source assembly is arranged around the periphery of the vibration diaphragm, for example, configured around the periphery of the vibration diaphragm.

In addition, in a further embodiment, the material of such a housing includes wood, not only the plastic.

In addition, in a further embodiment, the housing includes a hole, and the lighting source circuit is configured round the hole.

In addition, in a further embodiment, the outwardly facing portion of the housing provides with a vibration diaphragm, the light source assembly configured around the periphery of the vibration diaphragm.

In addition, in a further embodiment, for the sound signal to be played, the processing circuit filters out the low frequency signal and transmits the low frequency signal to an external low frequency speaker element through the communication circuit, and then play the sound signal.

For example, the processing circuit receives the bass information from another LED light through the wireless communication circuit, and plays music with the other LED light together, wherein the other LED light is mainly responsible for playing the Hi-Mid of the music.

In another approach, the processing circuit analyzes the sound information from the outside, transmit the Hi-Mid portion to another LED light through the wireless communication circuit, and play music with the other LED light together.

In another approach, the processing circuit synchronizes with another external speaker through the wireless communication circuit, and play music together. For example, the user may set the normal speaker to play the Hi-Mid part, and the LED light that may play the Mega bass synchronously.

In addition, in a further embodiment, the low frequency speaker element is disposed in another LED light. In other words, two bulbs mounted on the ceiling in accordance with the concept of this embodiment, one of which plays the Hi-Mid part of the music and the other enhances the bass part of the music. The other combinations of course also conform to the inventive concept behind this embodiment.

The LED light with the speaker of the invention has the following advantages: firstly, since the speaker assembly is located between the light source assembly and the driving assembly, and the through hole is set on the hollow heat sink, the optical effect may not be affected. At the same time, the advantages may expand the audio width, improve sound quality, conduct the internal space and the outside air completely and enhance the cooling effect; secondly, the influence of the speaker on the light emitting effect of the LED light may be reduced by the arrangement of the shock absorbing washer; in addition, the shock absorbing washer may form a relatively closed chamber after being abutted to the hollow heat sink, and then increase the volume of the speaker; finally, by setting the sound guide channel and the sound outlet, the bass sound quality may be improved significantly.

DETAILED DESCRIPTION OF THE PREFERRED EMBODIMENTS

Figure 1:
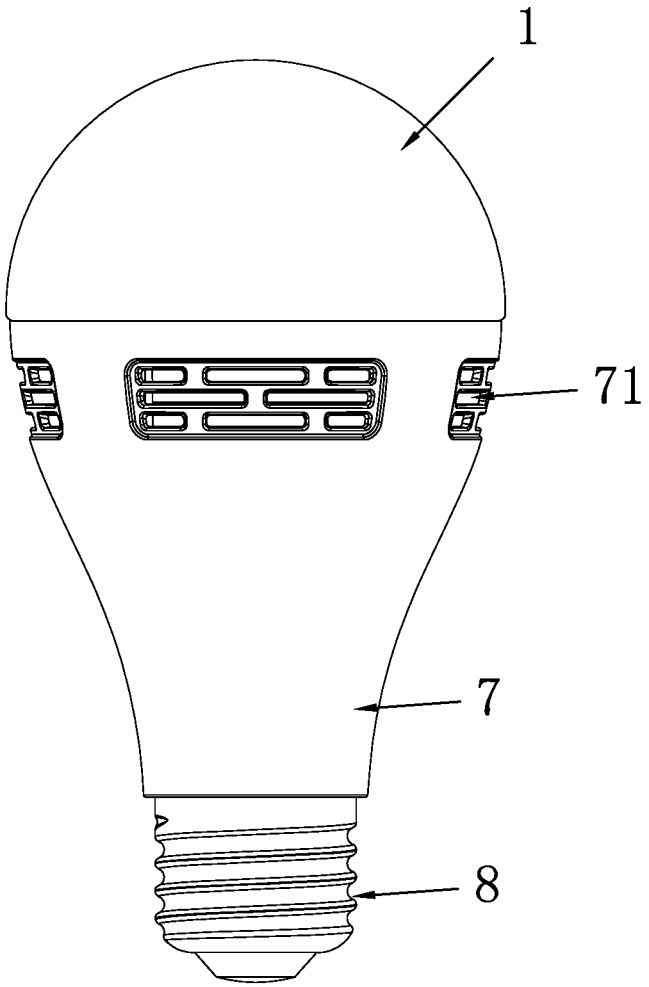
FIG. 1 illustrates a schematic structural view of a LED light with a speaker according to the embodiment of the present disclosure.
Figure 2:
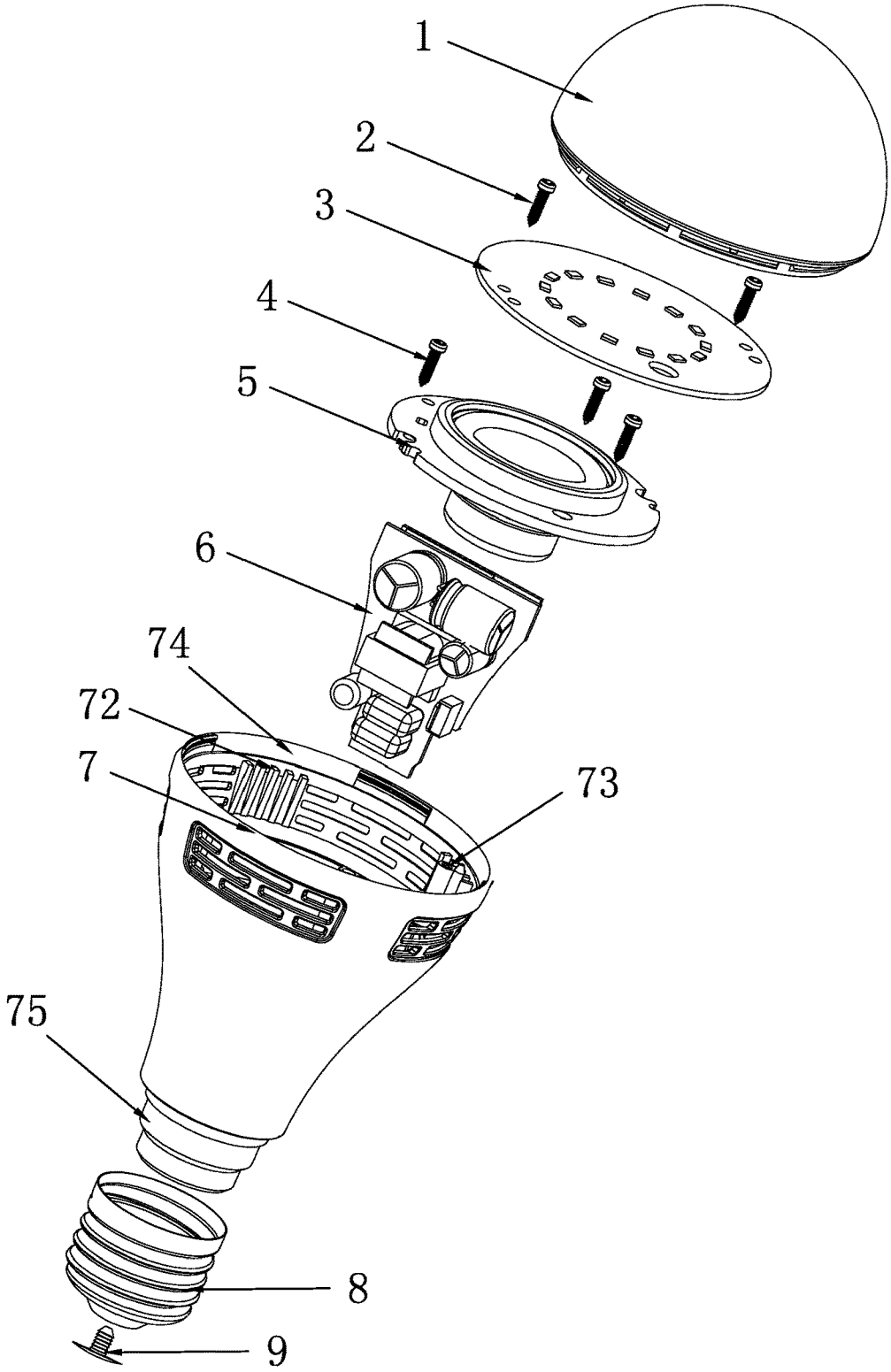
FIG. 2 illustrates a dismantling view of a LED light with a speaker according to the embodiment of the present disclosure.
Figure 3:
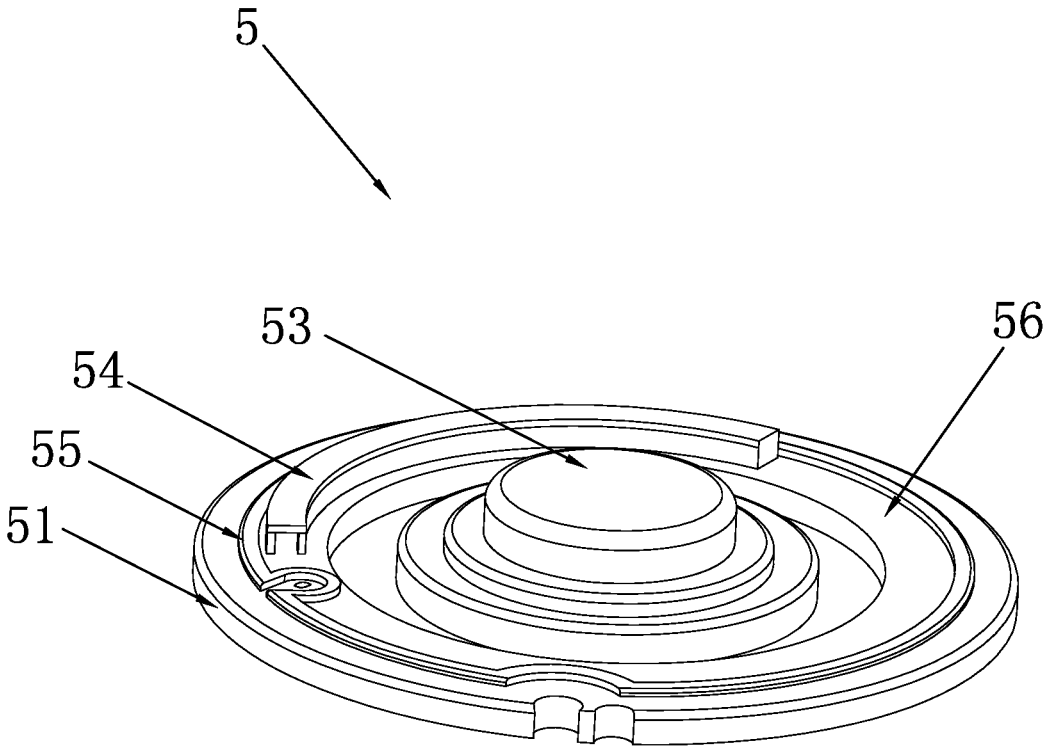
FIG. 3 illustrates a schematic stereogram of the speaker assembly of the LED light with a speaker in the direction of the first surface according to the embodiment of the present invention.
Figure 4:
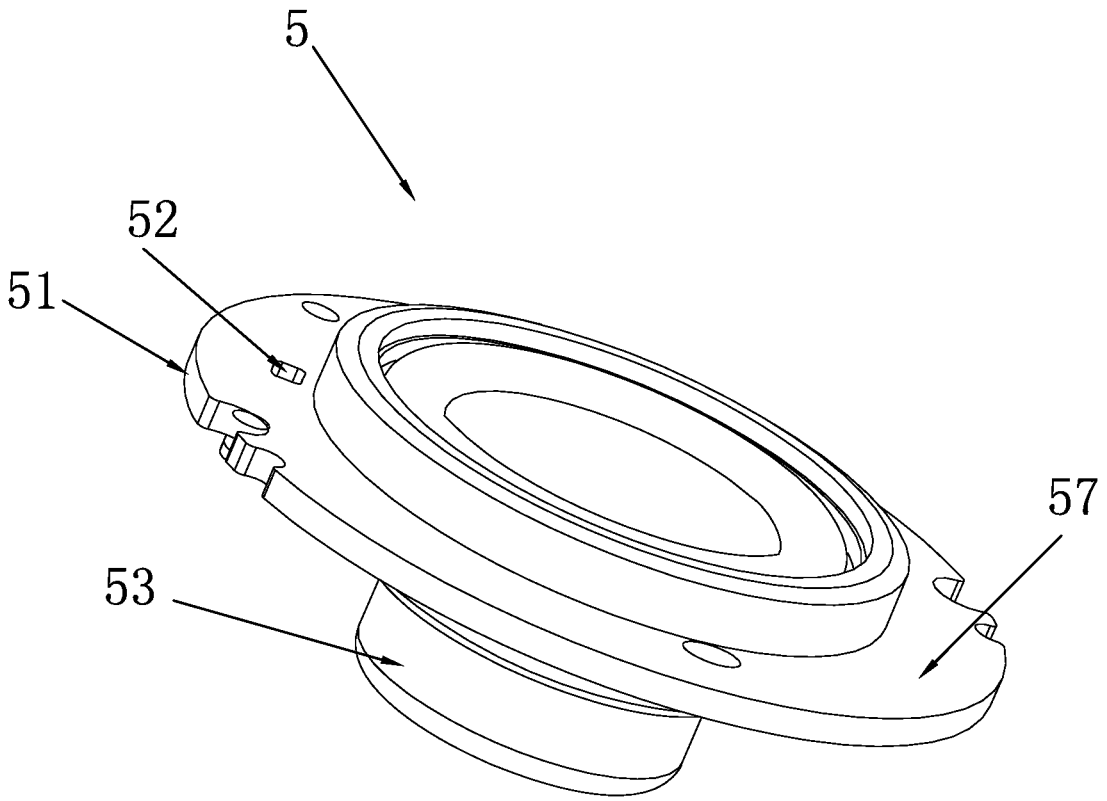
FIG. 4 illustrates a schematic stereogram of the speaker assembly of the LED light with a speaker in the direction of the second surface according to the embodiment of the present invention.

The invention may be described in the further detail with reference to the figures.

Please refer to FIG. 1 to FIG. 4, an LED light provided in the embodiment of the instant disclosure, including: a light cap 8, a hollow heat sink 7, a drive assembly 6, a speaker assembly 5, a light source assembly 3 and a lampshade 1. One end of the hollow heat sink 7 is connected to the light cap 8, and the other end of the hollow heat sink 7 is connected to the lampshade 1. The driver assembly 6, the speaker assembly 6 and the light source assembly 3 are set in sequence from bottom to top in the hollow heat sink 6, and the speaker assembly 5 and the light source assembly 3 are electrically connected to the drive assembly 6, respectively; multiple holes 71 are set on the side wall of the hollow heat sink 7 near the speaker assembly 5; the light source assembly 3 emits light toward the lampshade 1, the drive assembly 6 is used for wireless to communicate with an electronic terminal device (not shown in the figure) to control the drive assembly 6 to output a signal to the light source assembly 3 and the speaker assembly 5. The hollow heat sink 7 is a hollow cylindrical housing structure which is generally reduced in length from top to bottom, the hollow heat sink 7 is set with an upper connecting portion 74 at the top of the hollow heat sink 7, and the bottom of the hollow heat sink 7 is set with a lower connecting portion 75. The lampshade is fixed to the upper connecting portion 74 of the hollow heat sink 7 by means of glue or fastening. The light cap 8 is sleeved and fixed to the lower connecting portion 75 of the hollow heat sink 7 and is electrically connected with the driving assembly 6. Multiple holes 71 are elongated or rounded, and the holes 71 are spaced set on the side wall around the upper portion of the hollow heat sink 7. The heat sink is made of a heat dissipating plastic material integrally.

The lampshade 1 is a hemispherical shell structure, and the opening shape of the lampshade 1 is corresponded to the shape of the top of the hollow heat sink 7; the opening size of the lampshade 1 is corresponded to the inner diameter of the top of the hollow heat sin 7*k*, the lampshade 1 is made of a transparent or translucent material integrally.

The LED light further includes multiple screws 2/4, the inner wall of the hollow heat sink 7 is set with multiple support columns 73, two first mounting columns 73 and three second mounting columns (not shown in the figure). The top end faces of multiple support columns 72 are on the same horizontal plane as the top end faces of the first mounting columns 73; the top end faces of the second mounting columns are under the top end faces of the first mounting columns 73; the top end faces of the second mounting columns are on in one horizontal plane. When assembled, the speaker assembly 5 is set on the top end faces of the second mounting column and fixed to the second mounting column by screw 4; the light source assembly 3 is set on the top end face of the first mounting column 73 and fixed to the first mounting column 73 by the screw 2.

The speaker assembly 5 includes a substrate 51, a speaker 53, a shock absorbing washer 55, a sound guide channel 54 and a sound outlet 52; the substrate 51 includes a first surface 56 and a second surface 57 opposite to the first surface 56; the speaker 53, the shock absorbing washer 55, and the sound guide channel 54 are set on the first surface 56; the sound outlet 52 is set on the second surface 57 and communicated with the sound guide channel 54; and the lower end surface of the shock absorbing washer 55 is abutted to the inner wall of the hollow heat sink 7. Preferably, the sound guide channel is arc-shaped. The speaker 53 is provided in the middle of the first surface 56, the sound guide channel 54 may be provided near the speaker 53, the shock absorbing washer 55 may be provided around the speaker 53. It is to be understood that because of the shock absorbing washer 55, it is possible to prevent the substrate 51 from vibrating in contact with the inner wall of the hollow heat sink 7 to generate noise; in addition, the shock absorbing washer 55 may form a relatively closed chamber after being abutted to the hollow heat sink 7, and then increase the volume of the speaker 53. By setting the sound guide channel 54 and the sound outlet 52, the bass sound quality may be improved significantly.

The light cap 8 also provides with an eyelet 9, and a through hole (not shown in the figure) set at the top of light cap 8, one end of the eyelet 9 extending into the through hole.

Figure 5:
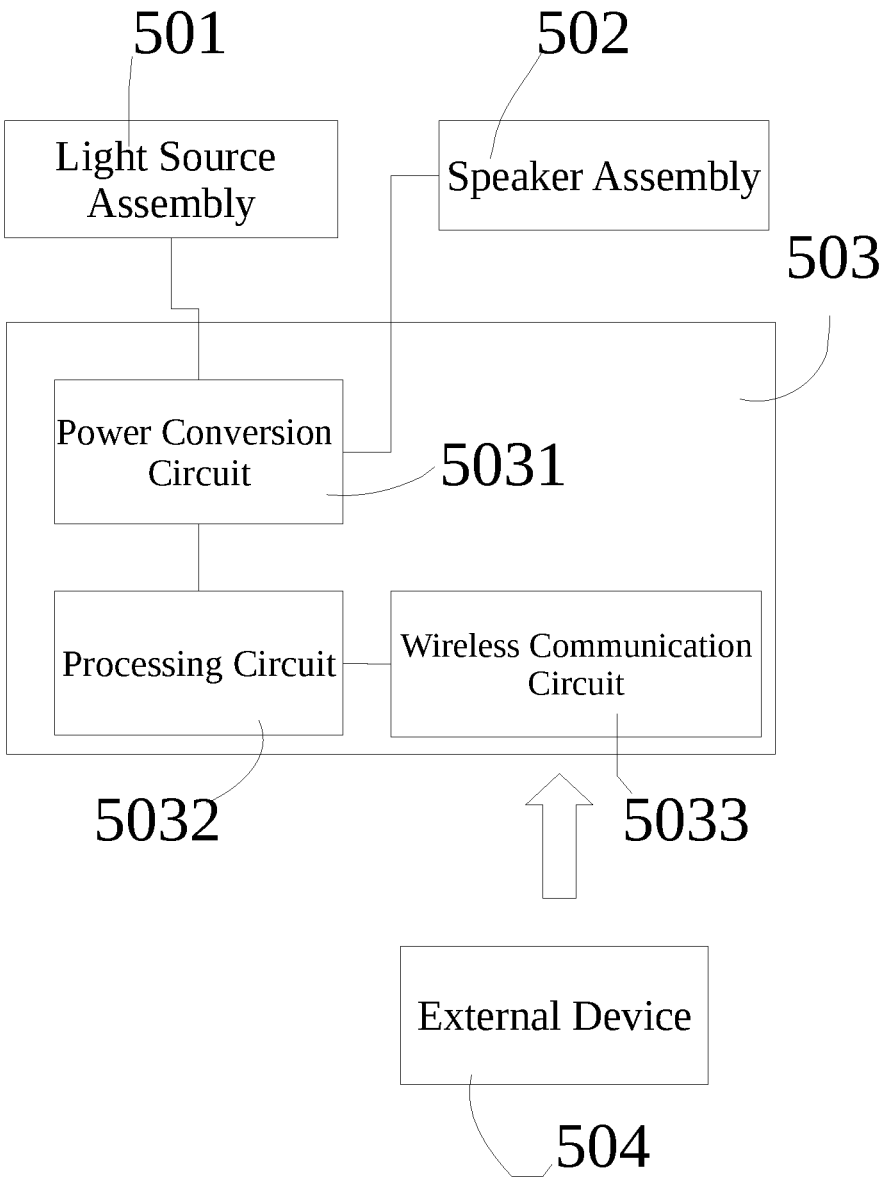
FIG. 5 illustrates a schematic view of the circuit element according to the embodiment of the present disclosure.

Please refer to FIG. 5. FIG. 5 illustrates a schematic view of the circuit element according to the embodiment of the present disclosure.

Another embodiment of the instant disclosure provides a LED light, the LED light is set with an Edison light cap, that is, a general standard light cap may be shifted to a general ceiling light socket or a desk light socket. A general indoor power, such as 110V or 220V voltage may be leaded into the LED light through the light cap.

The LED light further includes a drive assembly 503, a light source assembly 501 and a speaker assembly 502. The drive assembly 503 includes a power conversion circuit 5031 for converting the indoor power supply into a low voltage drive current to drive the light source assembly 5031 and the speaker assembly 502. The drive assembly 503 further includes a wireless communication circuit 5033 and a processing circuit 5032. The wireless communication circuit receives the sound information from the external device 504. The processing circuit 5032 converts the received sound information into a driving signal corresponding to the speaker assembly 502 and drives the speaker assembly 502 to play the corresponding sound.

For example, this wireless communication circuit is a Bluetooth communication circuit, and the sound streaming may be obtained from the matched phone, TV, home server and played through the speaker assembly.

For example, the wireless communication circuit 5053, in addition to the standard Bluetooth communication circuit, may include an additional communication circuit adopted a second wireless communication protocol, which is different from the first communication circuit protocol, such as the Bluetooth communication protocol. The second wireless protocol may interact with additional circuit, such as a wireless doorbell. When the wireless doorbell is pressed or the like, the additional communication circuit receives the touch information from the wireless doorbell, and the processing circuit plays the stored sound information to generate the sound of the doorbell. In addition, the processing circuit 5032 may further drive the light source assembly 501 to remind using the light with the doorbell. This may provide a better experience for elderly people or someone who are injured in hearing.

Other examples about the second communication protocol further include mobile phone calls from mobile phones, or notification messages about the wearer from the wearable device, such as smart bracelet.

In addition, when the wireless communication circuit 5033 receives information from the first and the second communication protocol at the same time, and when the sound need to be played, the processing circuit 5032 would select one of the following setting to play the sound according to the preset rule. The first setting is to pause the original playing sound, and play the sound effect corresponding to the new arrival information. For example, pause the playing music and play the doorbell. In order to avoid the doorbell be mistaken for a part of the music, pause the music first, match with light effect of the light source assembly 501, and then play the doorbell notification.

The second setting is to hold the second message directly when one of the higher priority information is playing. For example, if a WeChat information is received when listening music, the WeChat information may not play directly but play at some other time, such as the music empty space or the time a song changed.

The third setting is to play the two sound messages simultaneously.

The user may preset the rule at the time leaving the factory, or communicate with the processing circuit 5032 through an external device, such as the mobile phone, or the wireless communication circuit 5033, and make the relevant setting.

In addition, the LED light further providing a housing has a speaker effect. For example, the housing is an inverted tube speaker, and it may be designed to produce Mega bass by the structure design.

Figure 6:
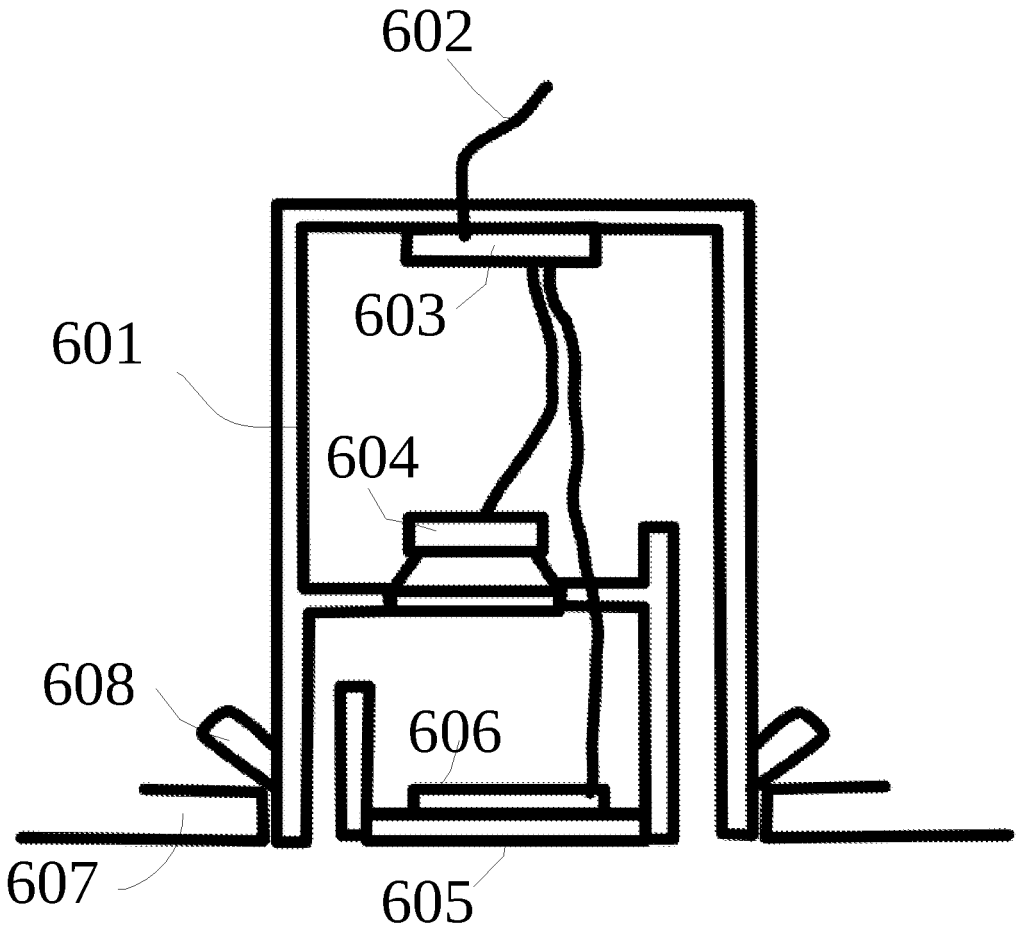
FIG. 6 illustrates an example of a LED light with a speaker according to the embodiment of the present disclosure.

For example, please refer to FIG. 6. FIG. 6 illustrates an example of a LED light with a speaker according to the embodiment of the present disclosure. The embodiment of FIG. 6 includes a housing 601, which forms a speaker. In addition, this embodiment includes a drive assembly 602 for converting the external power supply 602 into a corresponding drive current. This embodiment includes a speaker assembly 604 for issuing a sound effect. The sound may spread in the back space and the front space of the speaker, and the result of the diffusion resonance may be sent out through the hole. In addition, this embodiment also includes a light source assembly 606 and a soft light board 605 for softening the light of the light source assembly 606. This embodiment also includes a clip 608 for holding this embodiment in the preset accommodating space in the ceiling 607.

Another variant according to the above-described embodiment is that the housing in the design has no speaker. The outwardly facing portion of the housing includes a vibration diaphragm corresponding to the speaker assembly. The light source assembly is arranged around the periphery of the vibration diaphragm, for example, configured around the periphery of the vibration diaphragm.

Figure 7A:
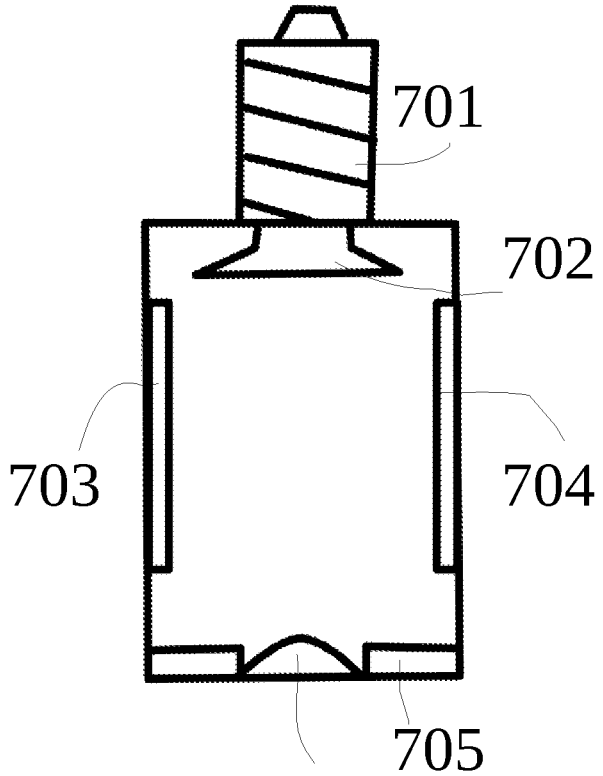
FIGS. 7A and 7B illustrates a design view of a LED light with another speaker according to the embodiment of the present disclosure.
Figure 7B:
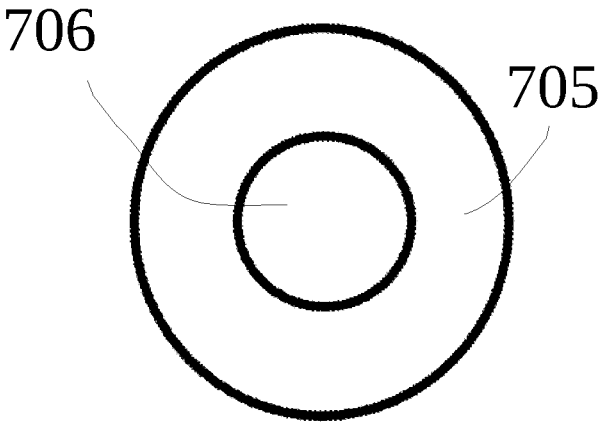

Please refer to FIGS. 7A and 7B. These two illustrations another embodiment with a speaker. FIG. 7A is a schematic cross-sectional view of this embodiment, and FIG. 7B is a bottom view of the embodiment of FIG. 7A.

The embodiment in FIGS. 7A and 7B includes a lamp cap 701, which may be transferred to a standard lamp slot. This embodiment also includes a speaker assembly 702 and a vibration diaphragm 706. Light emitting modules 703, 704 and 705 are provided around the housing. In other words, in addition to the bottom of the housing, the light emitting assembly may be provided around the side of the housing. In another embodiment, a resonance film may also be provided on the side of the housing.

Figure 8:
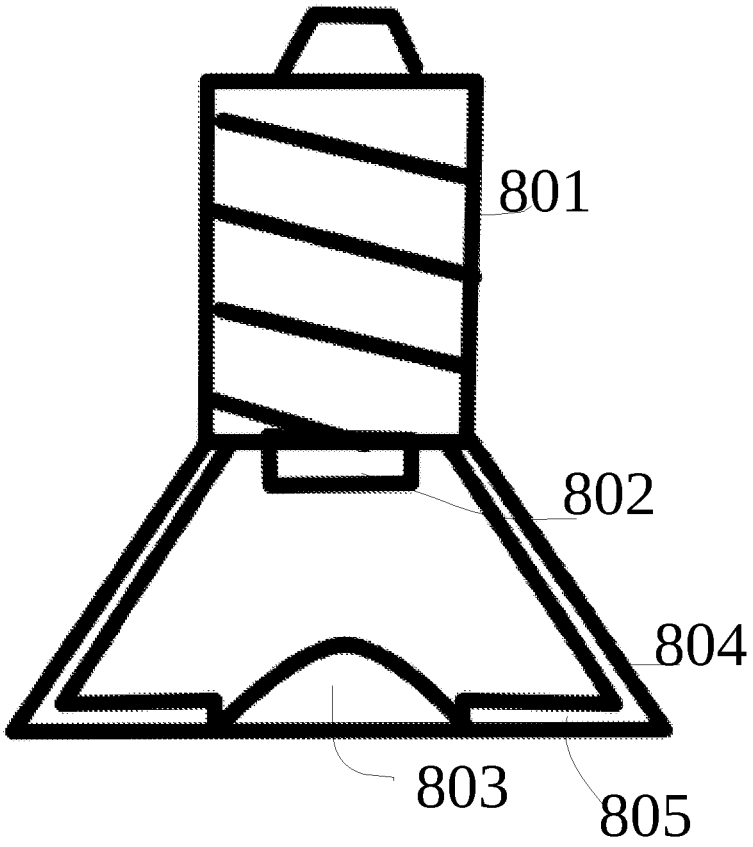
FIG. 8 illustrates an example of another LED light according to the embodiment of the present disclosure.

Please refer to FIG. 8. FIG. 8 illustrates an example of another LED light according to the embodiment of the present disclosure. The LED light in the embodiment of FIG. 8 includes a light cap 801, a speaker assembly 802, a resonance film 803, and light emitting modules 804, 805. The light emitting module may be disposed in a region other than the resonance film 803. It may be known from the above examples that the shape of the bulb may be in a variety of different shapes, and the designer may design according to different needs and specifications, but all may fall within the scope of the present invention.

In addition, in a further embodiment, the material of such the housing includes wood, not only the plastic.

In addition, in a further embodiment, the housing includes a hole, and the lighting source circuit is configured round the hole.

In addition, in a further embodiment, the outwardly facing portion of the housing provides with a vibration diaphragm, the light source assembly configured around the periphery of the vibration diaphragm.

In addition, in a further embodiment, for the sound signal to be played, the processing circuit filters out the low frequency signal and transmits it to an external low frequency speaker element through the communication circuit, and then play it.

For example, the processing circuit receives the bass information from another LED light through the wireless communication circuit, and plays music with the other LED light together, wherein the other LED light is mainly responsible for playing the Hi-Mid of the music.

In another approach, the processing circuit analyzes the sound information from the outside, transmit the Hi-Mid portion to another LED light through the wireless communication circuit, and play music with the other LED light together.

In another approach, the processing circuit synchronizes with another external speaker through the wireless communication circuit, and play music together. For example, the user may set the normal speaker to play the Hi-Mid part, and the LED light that may play the Mega bass to play the Mega bass synchronously.

In addition, in a further embodiment, the low frequency speaker element is disposed in another LED light. In other words, two bulbs are mounted on the ceiling in accordance with the concept of this embodiment. One of which plays the Hi-Mid part of the music and the other enhances the bass part of the music. The other combinations of course also conform to the inventive concept behind this embodiment.

Figure 9:
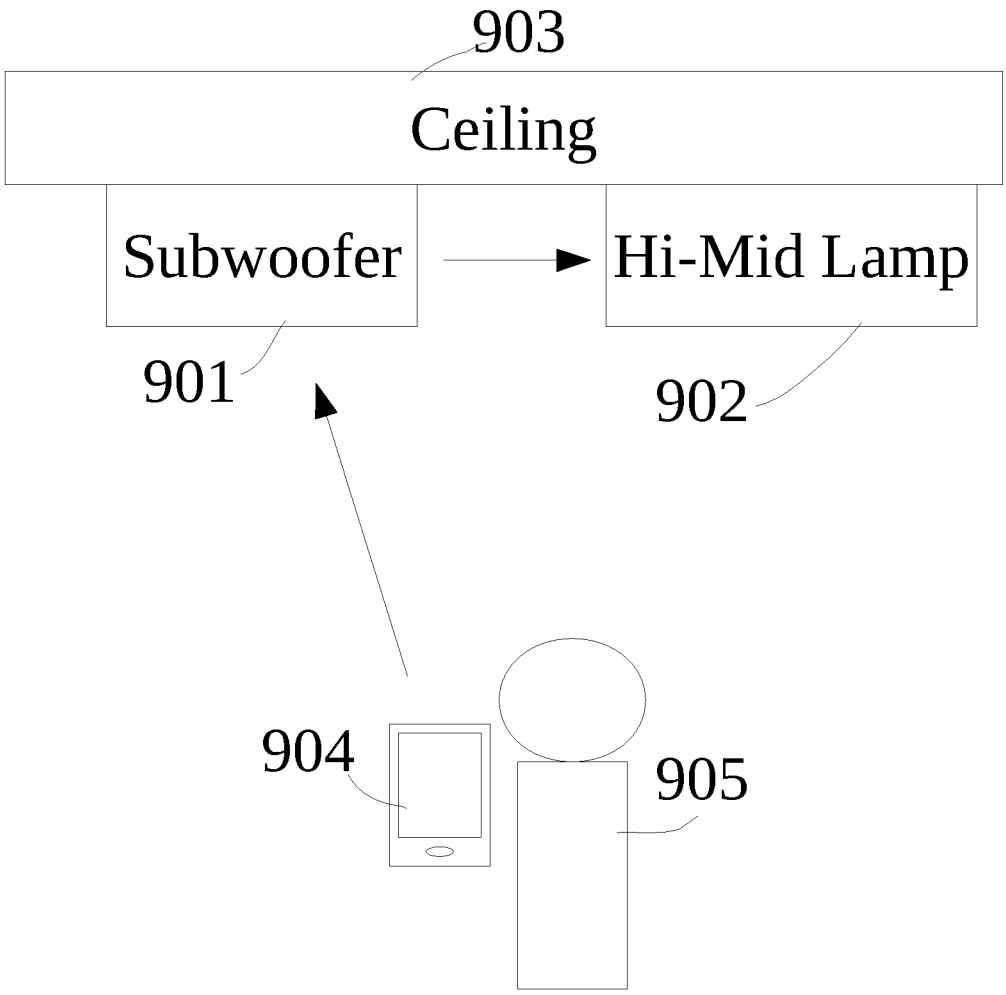
FIG. 9 illustrates an example of two LED lights playing music together according to the embodiment of the present disclosure.

Please refer to FIG. 9. FIG. 9 illustrates an embodiment according to the above-mentioned description. The user 905 inserts a subwoofer 901 and a Mid-Hi range lamp into a ceiling 903 bulb standard slot at home or office. The user 905 uses the cellphone 904 to transmit the music stream to the bass lamp 901 through a standard Bluetooth communication protocol. The processing circuit of the bass lamp 901 filters out the bass portion and play. In addition, the processing circuit of the bass lamp transmits the Hi-Mid portion to the Hi-Mid lamp 902 for playback. In other words, the user may enjoy the bass-enhanced effect without complex settings.

The Hi-Mid lamp 902 referred to herein may be a device specifically designed to match with the bass 901. In another embodiment, the bass lamp 901 may also design a second Bluetooth circuits and use the second Bluetooth circuits to match with the Hi-Mid lamp 902. At this time, the Hi-Mid lamp may take the bass 901 as a general Bluetooth sound source circuit, and play in accordance with the established way.

In other words, even if the Hi-Mid lamp 902 is Bluetooth player without any specially design, the user may enjoy the upgraded sound effect immediately by purchasing a bass lamp with such a design.

In addition, in some embodiments, the bass 901 may also play music with other speakers that are not lamps. Since the bass lamp 901 may be fixed to the ceiling with a standard jack, therefore, not only this sound may be played is easily, but also the user's experience of listening to music may be enhanced.

The above-mentioned is only the preferred embodiments of the invention and may not limit the invention. Any modifications, equivalent substitutions, improvements, and the like within the spirit and principles of the invention, all may fall within the scope of the present invention.

The invention claimed is:

1. An LED light, comprising:

a light cap;

a hollow heat sink;

a drive assembly;

a speaker assembly;

a light source assembly; and a lampshade;

wherein the inner wall of the hollow heat sink is set with a plurality of support columns, when assembled, the speaker assembly and the light source assembly are fixed to the support columns, and wherein one end of the hollow heat sink is connected to the light cap, and the other end of the hollow heat sink is connected to the lampshade;

wherein the driver assembly, the speaker assembly and the light source assembly are set in sequence from bottom to top in the hollow heat sink, and the speaker assembly and the light source assembly are electrically connected to the drive assembly, respectively; wherein a plurality of holes are set on the side wall of the hollow heat sink near the speaker assembly; and wherein the light source assembly emits light toward the lampshade, and the drive assembly is used for wireless communication with an electronic terminal device to control the drive assembly to output a signal to the light source assembly and the speaker assembly.

2. The LED light of claim 1, wherein the hollow heat sink is a hollow cylindrical housing structure and is generally reduced in length from top to bottom, the hollow heat sink is set with an upper connecting portion at the top of the hollow heat sink, and the bottom of the hollow heat sink is provided with a lower connecting portion.

3. The LED light of claim 1, wherein the lampshade is a hemispherical shell structure, and the opening shape of the lampshade is corresponded to the shape of the top of the hollow heat sink, and the opening size of the lampshade is corresponded to the inner diameter of the top of the hollow heat sink, and the lampshade is made of a transparent or translucent material integrally.

4. The LED light of claim 1, wherein the lampshade is fixed to the upper connecting portion of the hollow heat sink by means of glue or fastening.

5. The LED light of claim 2, wherein the light cap is sleeved and fixed to the lower connecting portion of the hollow heat sink and is electrically connected with the driving assembly.

6. The LED light of claim 1, further comprising a plurality of screws and the inner wall of the hollow heat sink set with the plurality of support columns, two first mounting columns and three second mounting columns, the top end faces of a plurality of support columns located on the same horizontal plane as the top end faces of the first mounting columns, the top end faces of the second mounting columns located under the top end faces of the first mounting columns, the top end faces of the second mounting columns located on in one horizontal plane; when assembled, the speaker assembly is set on the top end faces of the second mounting column and is fixed to the second mounting column by screw, the light source assembly is set on the top end face of the first mounting column and is fixed to the first mounting column by the screw.

7. The LED light of claim 1, wherein the speaker assembly comprises a substrate, a speaker, a shock absorbing washer, a sound guide channel and a sound outlet, the substrate comprises a first surface and a second surface that opposite to the first surface, the speaker, the shock absorbing washer, and the sound guide channel are set on the first surface, and the sound outlet is set on the second surface and communicates with the sound guide channel, and the lower end surface of the shock absorbing washer is abutted to the inner wall of the hollow heat sink.

8. The LED light of claim 7, wherein aid sound guide channel is arc-shaped.

9. The LED light of claim 1, wherein the plurality of holes are elongated or rounded, and the holes are interval set on the side wall around the upper portion of the hollow heat sink.

10. The LED light of claim 1, wherein the heat sink is made of a heat dissipating plastic material integrally.

* * * * *